US009443678B1

(12) United States Patent
Chambers

(10) Patent No.: US 9,443,678 B1
(45) Date of Patent: Sep. 13, 2016

(54) TATTOO MACHINE FOOT SWITCH

(71) Applicant: Ian Chambers, Baldwin Park, CA (US)

(72) Inventor: Ian Chambers, Baldwin Park, CA (US)

(73) Assignees: Michael Chen, Baldwin Park, CA (US); Wen Wei, Baldwin Park, CA (US); Billy Chen, Baldwin Park, CA (US)

( * ) Notice: Subject to any disclaimer, the term of this patent is extended or adjusted under 35 U.S.C. 154(b) by 22 days.

(21) Appl. No.: 14/558,405

(22) Filed: Dec. 2, 2014

(51) Int. Cl.
*H01H 3/14* (2006.01)
*H01H 21/12* (2006.01)
*H01H 21/26* (2006.01)

(52) U.S. Cl.
CPC ..... *H01H 21/12* (2013.01); *H01H 21/26* (2013.01); *H01H 2217/024* (2013.01); *H01H 2221/016* (2013.01); *H01H 2221/044* (2013.01)

(58) Field of Classification Search
CPC ..... H01H 21/12; H01H 21/26; G05G 1/30; G05G 1/405
USPC ..... 200/86.5; 74/512, 560, 561
See application file for complete search history.

(56) References Cited

U.S. PATENT DOCUMENTS 1,355,573 A * 10/1920 Rundback ..... H01H 21/26 200/86 R
4,172,217 A 10/1979 Miller
4,965,417 A * 10/1990 Massie ..... H01H 21/26 200/86.5
5,635,777 A * 6/1997 Telymonde ..... H01H 3/14 200/86.5
6,608,267 B2 8/2003 Fischer
7,442,042 B1 10/2008 Lewis
7,498,532 B2 3/2009 Kuhner
8,228,666 B2 7/2012 Rickard

* cited by examiner

*Primary Examiner* — Renee S Luebke
*Assistant Examiner* — Lheiren Mae A Caroc
(74) *Attorney, Agent, or Firm* — QuickPatents, LLC; Kevin Prince

(57) ABSTRACT

A foot-pedal switch for electrically connecting two conductors includes a conductive base plate connected to one of the two conductors and having a bottom surface for resting on a horizontal surface, a rear end having a first portion of a hinge assembly, at least one non-conductive spring, and a first conductive contact point at a front end thereof. A conductive top plate is connected to the other conductor, a rear end having a second portion of the hinge assembly, and a second conductive contact point at a front end thereof. A non-conductive hinge pin assembly pivotally connects the first and second portions of the hinge assembly mutually and non-conductively together. The top plate rests on the springs such that the first and second contact points are electrically and mechanically separated until pressure is applied to the top plate to deform the springs until the contact points electrically connect.

13 Claims, 3 Drawing Sheets

TATTOO MACHINE FOOT SWITCH

CROSS-REFERENCE TO RELATED APPLICATIONS

Not Applicable.

STATEMENT REGARDING FEDERALLY SPONSORED RESEARCH AND DEVELOPMENT

Not Applicable.

FIELD OF THE INVENTION

This invention relates to switches, and more particularly to a foot-pedal switch.

DISCUSSION OF RELATED ART

Foot pedals for electrically connecting two conductors, such as for tattoo machines, dental equipment, and the like are known in the art. Most such foot pedals are essentially complicated switches that, due to their complexity, often fail when subjected to repeated use and under the typical pressure applied by operators thereof. Such prior art food pedal switches are normally closed, requiring a spring or other mechanism that urges a top portion upwards and that can be overcome with pressure of a person's foot to travel downward to complete a circuit. When the spring or other urging mechanism wears in such prior art devices, it is difficult if not impossible to replace or repair the spring or other urging mechanism.

Therefore, there is a need for a foot-pedal device that has a minimal number of moving parts, can be easily used with a replaceable clip cords as opposed to a soldered cord, and allows for easy replacement of the springs if they become worn. Such a needed device would be relatively simple to manufacture and use. The present invention accomplishes these objectives.

SUMMARY OF THE INVENTION

The present device is a foot-pedal switch for electrically connecting two conductors, such as a switch cable for a tattoo machine or the like. An electrically-conductive base plate has a bottom surface adapted for resting on a horizontal surface, such as a floor surface. The foot-pedal switch further includes a rear end having a first portion of a hinge assembly, at least one and preferably two non-conductive elastomeric springs, and a first electrically-conductive contact point at a front end thereof. An electrically-conductive top plate has a top surface adapted for pressing, a rear end having a second portion of the hinge assembly, and a second electrically-conductive contact point at a front end thereof. A non-conductive hinge pin assembly is adapted for pivotally connecting the first and second portions, of the hinge assembly mutually and non-conductively together. The top plate rests on the at least one non-conductive elastomeric spring such that the first and second contact points, are electrically and mechanically separated.

The rear end of the base plate, in one embodiment, includes a first conductor aperture, while the rear end of the top plate includes a second conductor aperture. As such, the two conductors may be fixed with the top plate and the base plate at the first and second conductor apertures. A non-conductive spring clip may be included in such an embodiment and adapted for pressing each conductor into either the first or second conductor apertures, and for retaining the conductors therein.

The present invention is a foot-pedal device that has a minimal number of moving parts, can be easily used with a replaceable clip cords as opposed to a soldered cord, and allows for easy replacement of the springs if they become worn. The present device is relatively simple to manufacture and use. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
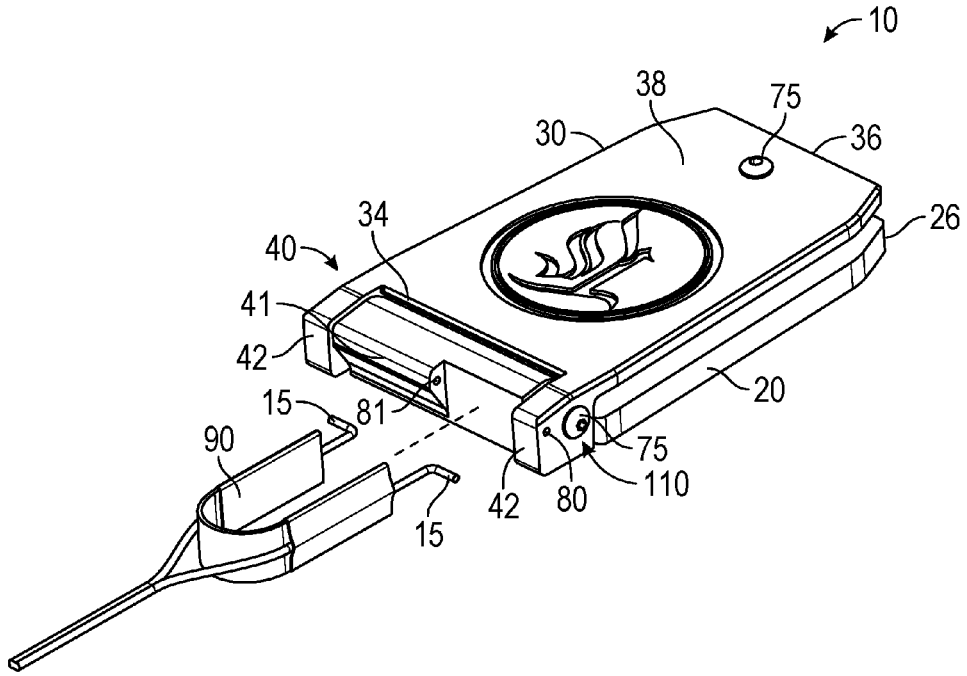
FIG. 1 is a perspective view of the invention.
Figure 2:
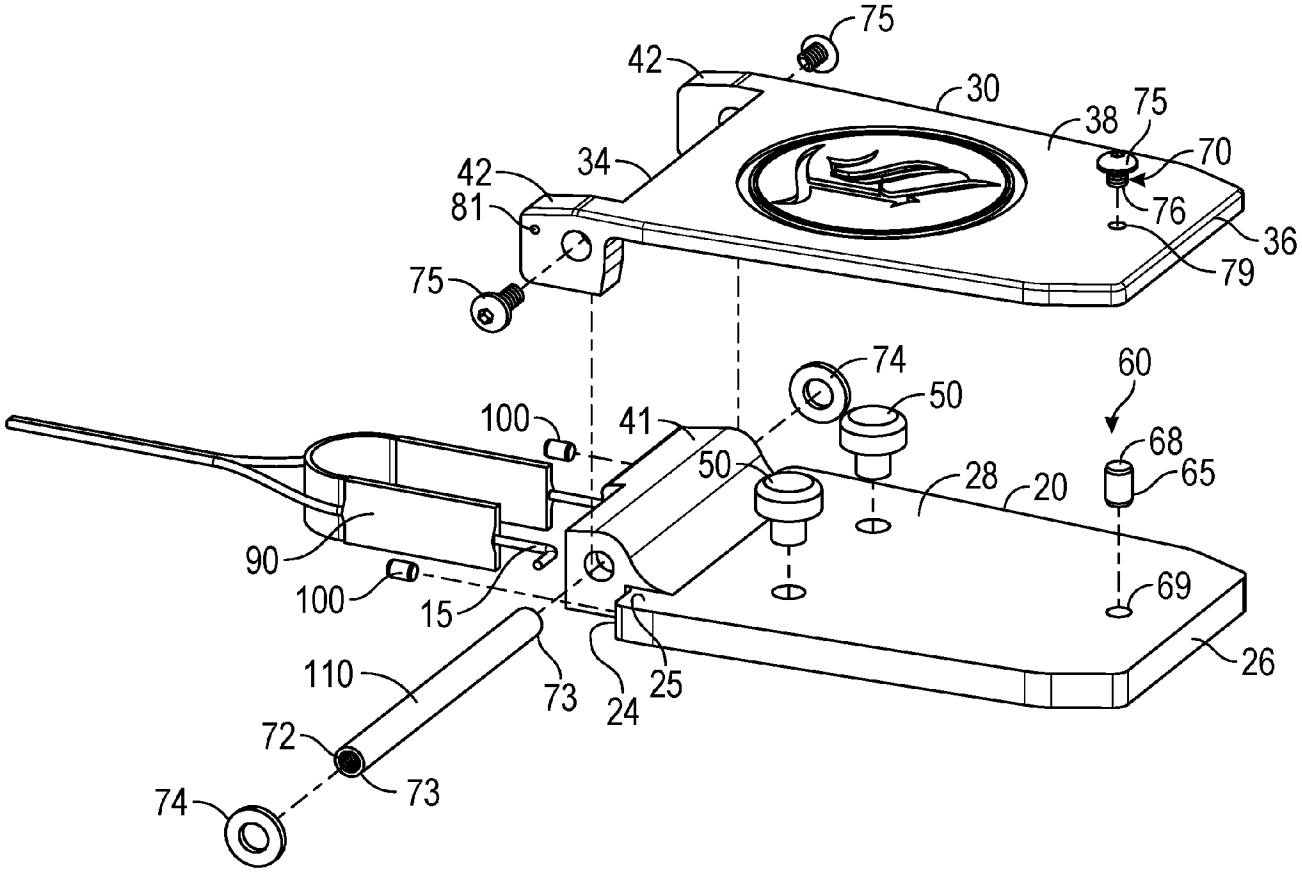
FIG. 2 is an exploded perspective view thereof.
Figure 3:
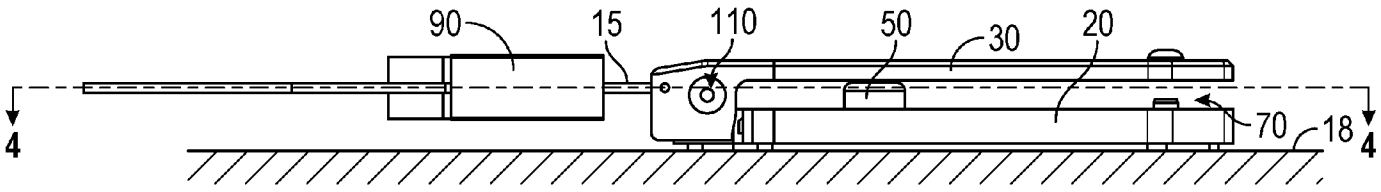
FIG. 3 is a side elevational view of the invention.

FIGS. 1 and 2 illustrate a foot-pedal switch 10 for electrically connecting two conductors 15. An electrically-conductive base plate 20 has a bottom surface 22 adapted for resting on a horizontal surface 18, such as a floor surface (FIG. 3). The foot-pedal switch 10 further includes a rear end 24 having a first portion 41 of a hinge assembly 40, at least one and preferably two non-conductive elastomeric springs 50, and a first electrically-conductive contact point 60 at a front end 26 thereof. Preferably the base plate 20 is made from a rigid, conductive metal material. Each elastomeric spring 50 is preferably made from a non-conductive rubber or plastic material.

An electrically-conductive top plate 30 has a top surface 38 adapted for pressing, a rear end 34 having a second portion 42 of the hinge assembly 40, and a second electrically-conductive contact point 70 at a front end 36 thereof. Preferably the top plate 30 is made from a rigid, conductive metal material.

A non-conductive hinge pin assembly 110 is adapted for pivotally connecting the first and second portions 41,42 of the hinge assembly 40 mutually and non-conductively together. The top plate 30 rests on the at least one non-conductive elastomeric spring 50 such that the first and second contact points 60,70 are electrically and mechanically separated. Preferably the hinge pin assembly 110 includes a non-conductive hinge pin 71 having a threaded apertures 72 on each of two opposing ends 73 thereof, and a pair of non-conductive washers 74, and a pair of threaded mechanical fasteners 75, such that the hinge pin assembly 110 may be assembled through the base plate 20 and the top plate 30 to mutually, pivotally, and non-conductively attach the base plate 20 to the top plate 30.

Preferably the first contact point 60 is a top end 68 of a conductive post 65 inserted into a contact aperture 69 in a top side 28 of the base plate 20 (FIG. 2). The second contact point 70 is preferably an end 76 of a conductive threaded mechanical fastener 75 rotationally fixed through a threaded aperture 79 traversing the top plate 30 (FIG. 2).

Figure 4:
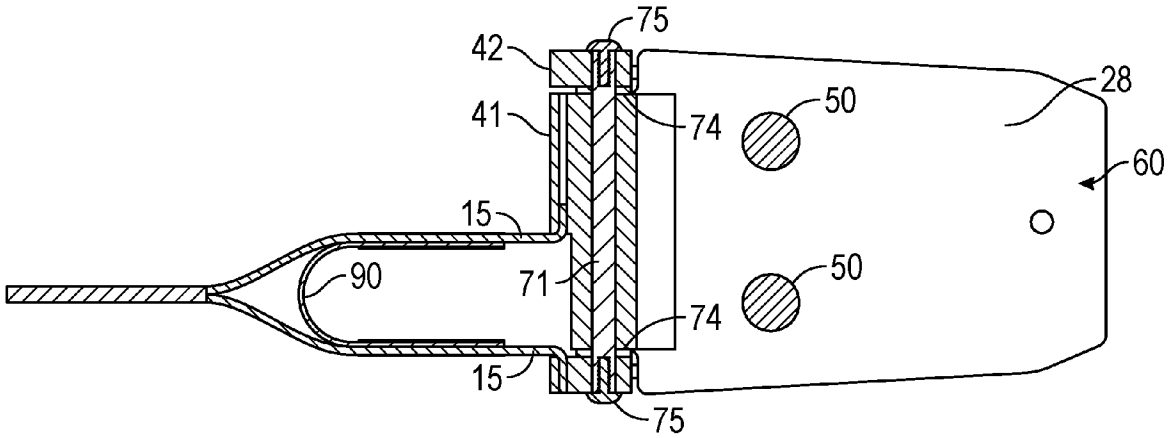
FIG. 4 is a cross-sectional view thereof, taken generally along lines 4-4 of FIG. 3.

The rear end 24 of the base plate 20, in one embodiment, includes a first conductor aperture 80, while the rear end 34 of the top plate 30 includes a second conductor aperture 81. As such, the two conductors 15 may be fixed with the top plate 30 and the base plate 20 at the first and second conductor apertures 80,81. A non-conductive spring clip 90 may be included in such an embodiment and adapted for pressing each conductor 15 into either the first or second conductor apertures 80,81 and for retaining the conductors 15 therein (FIG. 4).

A pair of non-conductive spacers 100 may each be fixed between a shoulder 25 of the base plate 20 and the second portion 42 of the hinge assembly 40. As such, electrical conduction between the top plate 30 and the base plate 20 is prevented when lifting the top plate 30 with respect to the base plate 20.

With the two conductors 15 electrically connected one each with the base plate 20 and the top plate 30, pressure on the top plate 30 causes the top plate 30 to pivot towards the base plate 20 by deforming the at least one elastomeric spring 50 until the first and second contact points 60,70 electrically and mechanically connect.

While a particular form of the invention has been illustrated and described, it will be apparent that various modifications can be made without departing from the spirit and scope of the invention. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A foot-pedal switch for electrically connecting two conductors, comprising:

an electrically-conductive base plate having a bottom surface adapted for resting on a horizontal surface, a rear end having a first portion of a hinge assembly, at least one non-conductive elastomeric spring, and a first electrically-conductive contact point at a front end thereof;

an electrically-conductive top plate having a top surface adapted for pressing, a rear end having a second portion of the hinge assembly, and a second electrically-conductive contact point at a front end thereof; and a non-conductive hinge pin assembly adapted for pivotally connecting the first and second portions of the hinge assembly mutually and non-conductively together, the top plate resting on the at least one non-conductive elastomeric spring such that the first and second contact points are electrically and mechanically separated, the non-conductive hinge pin having a threaded aperture on each of two opposing open ends thereof, a pair of non-conductive washers, and a pair of threaded mechanical fasteners;

whereby with the two conductors electrically connected one each with the base plate and the top plate, pressure on the top plate causes the top plate to pivot towards the base plate by deforming the at least one elastomeric spring until the first and second contact points electrically and mechanically connect.

2. The foot-pedal switch of claim 1 wherein the at least one non-conductive elastomeric spring is exactly two non-conductive elastomeric springs.

3. The foot-pedal switch of claim 1 further including a pair of non-conductive spacers each fixed between a shoulder of the base plate and the second portion of the hinge assembly, such that electrical conduction between the top plate and the base plate is prevented when lifting the top plate with respect to the base plate.

4. A foot-pedal switch for electrically connecting two conductors, comprising:

an electrically-conductive base plate having a bottom surface adapted for resting on a horizontal surface, a rear end having a first portion of a hinge assembly, at least one non-conductive elastomeric spring, and a first electrically-conductive contact point at a front end thereof;

an electrically-conductive top plate having a top surface adapted for pressing, a rear end having a second portion of the hinge assembly, and a second electrically-conductive contact point at a front end thereof; and a non-conductive hinge pin assembly adapted for pivotally connecting the first and second portions of the hinge assembly mutually and non-conductively together, the top plate resting on the at least one non-conductive elastomeric spring such that the first and second contact points are electrically and mechanically separated;

wherein the second contact point is an end of a conductive threaded mechanical fastener rotationally fixed through a threaded aperture traversing the top plate;

whereby with the two conductors electrically connected one each with the base plate and the top plate, pressure on the top plate causes the top plate to pivot towards the base plate by deforming the at least one elastomeric spring until the first and second contact points electrically and mechanically connect.

5. The foot-pedal switch of claim 4 wherein the at least one non-conductive elastomeric spring is exactly two non-conductive elastomeric springs.

6. The foot-pedal switch of claim 4 further including a pair of non-conductive spacers each fixed between a shoulder of the base plate and the second portion of the hinge assembly, such that electrical conduction between the top plate and the base plate is prevented when lifting the top plate with respect to the base plate.

7. A foot-pedal switch for electrically connecting two conductors, comprising:

an electrically-conductive base plate having a bottom surface adapted for resting on a horizontal surface, a rear end having a first portion of a hinge assembly, at least one non-conductive elastomeric spring, and a first electrically-conductive contact point at a front end thereof;

an electrically-conductive top plate having a top surface adapted for pressing, a rear end having a second portion of the hinge assembly, and a second electrically-conductive contact point at a front end thereof; and a non-conductive hinge pin assembly adapted for pivotally connecting the first and second portions of the hinge assembly mutually and non-conductively together, the top plate resting on the at least one non-conductive elastomeric spring such that the first and second contact points are electrically and mechanically separated;

wherein the first contact point is a top end of a conductive post inserted into a contact aperture in a top side of the base plate;

whereby with the two conductors electrically connected one each with the base plate and the top plate, pressure on the top plate causes the top plate to pivot towards the base plate by deforming the at least one elastomeric spring until the first and second contact points electrically and mechanically connect.

8. The foot-pedal switch of claim 7 wherein the at least one non-conductive elastomeric spring is exactly two non-conductive elastomeric springs.

9. The foot-pedal switch of claim 7 further including a pair of non-conductive spacers each fixed between a shoulder of the base plate and the second portion of the hinge assembly, such that electrical conduction between the top plate and the base plate is prevented when lifting the top plate with respect to the base plate.

10. A foot-pedal switch for electrically connecting two conductors, comprising:

an electrically-conductive base plate having a bottom surface adapted for resting on a horizontal surface, a rear end having a first portion of a hinge assembly, at least one non-conductive elastomeric spring, and a first electrically-conductive contact point at a front end thereof;

an electrically-conductive top plate having a top surface adapted for pressing, a rear end having a second portion of the hinge assembly, and a second electrically-conductive contact point at a front end thereof; and a non-conductive hinge pin assembly adapted for pivotally connecting the first and second portions of the hinge assembly mutually and non-conductively together, the top plate resting on the at least one non-conductive elastomeric spring such that the first and second contact points are electrically and mechanically separated;

wherein the rear end of the base plate includes a first conductor aperture and the rear end of the top plate includes a second conductor aperture, whereby the two conductors may be fixed with the top plate and the base plate at the first and second conductor apertures;

whereby with the two conductors electrically connected one each with the base plate and the top plate, pressure on the top plate causes the top plate to pivot towards the base plate by deforming the at least one elastomeric spring until the first and second contact points electrically and mechanically connect.

11. The foot-pedal switch of claim 10 further including a non-conductive spring clip adapted for pressing each conductor into either the first or second conductor apertures and for retaining the conductors therein.

12. The foot-pedal switch of claim 10 wherein the at least one non-conductive elastomeric spring is exactly two non-conductive elastomeric springs.

13. The foot-pedal switch of claim 10 further including a pair of non-conductive spacers each fixed between a shoulder of the base plate and the second portion of the hinge assembly, such that electrical conduction between the top plate and the base plate is prevented when lifting the top plate with respect to the base plate.

* * * * *